US007370567B2

(12) United States Patent
Jones et al.

(10) Patent No.: US 7,370,567 B2
(45) Date of Patent: May 13, 2008

(54) ARMORED PLATING SYSTEM

(75) Inventors: Dan Jones, Valley Mills, TX (US); Devane Clarke, Dallas, TX (US)

(73) Assignee: Rampgate, Ltd., Waco, TX (US)

( * ) Notice: Subject to any disclaimer, the term of this patent is extended or adjusted under 35 U.S.C. 154(b) by 135 days.

(21) Appl. No.: 11/087,082

(22) Filed: Mar. 22, 2005

(65) Prior Publication Data

US 2008/0083323 A1 Apr. 10, 2008

(51) Int. Cl.
*F41H 5/02* (2006.01)

(52) U.S. Cl. ..... 89/36.02; 89/184

(58) Field of Classification Search ..... 89/36.02, 89/36.08, 36.01, 36.04, 36.11, 36.09; 428/911, 428/544, 548, 121, 156, 144, 184; 109/49.5; 104/112; 254/264, 386
See application file for complete search history.

(56) References Cited

U.S. PATENT DOCUMENTS 4,879,066 A * 11/1989 Crompton ..... 252/606
5,435,226 A * 7/1995 McQuilkin ..... 89/36.02
5,591,933 A * 1/1997 Li et al. ..... 89/36.02
5,776,839 A * 7/1998 Dischler et al. ..... 442/239
5,806,796 A * 9/1998 Healey ..... 244/117 R
7,087,296 B2 * 8/2006 Porter ..... 428/223

* cited by examiner

*Primary Examiner*—Michael J. Carone
*Assistant Examiner*—Benjamin P Lee
(74) *Attorney, Agent, or Firm*—Fulbright & Jaworksi LLP

(57) ABSTRACT

An improved armored plating system having a series of elongate tubes arranged in parallel fashion to form a protective array. Each tube has a rectilinear cross section with slanted sidewalls so that each tube partially overlaps the following tube and is partially overlapped by the previous tube. As such, the protective array may be placed on a curved surface while having no gaps in protection. The protective array is formed as alternating tubes slide past one another from opposing directions. A series of laminated members and an embossed member are slideably inserted into each tube and layered upon one another.

4 Claims, 4 Drawing Sheets

ARMORED PLATING SYSTEM

BACKGROUND OF THE INVENTION

1. Field of the Invention

The present invention generally relates to an armored plating system. More specifically, the present invention relates to an improved armored plating system having laminated pieces and an embossed piece layered upon one another and where these pieces are contained in a series of array-forming tubes.

2. Background Information

The importance of armored plating seems obvious, yet cannot be overstated. One could reasonably argue that the importance of having reliable armored plating is more important than it ever has been. Such an argument could be made in view of several recent changes around the world. Currently, United States troops are placed under enemy fire on a daily basis on foreign soil. It is common to see daily casualty reports streaming in from the likes of Iraq and Afghanistan. In some instances, these casualties are made worse by troops not wearing protective armor; or, because the armor the troops were wearing could not stop the incoming bullet or shrapnel.

Although it may seem nonintuitive, an individual may choose not to wear known armored protection for several reasons. That is, the fiberglass composite used in known armor is friable. As such, particles associated with the composite often become embedded in one's skin or may be inhaled. Further, the long-range health implications associated with human interaction with these particles are not completely understood.

Known armored plating is inadequate for other reasons as well. It is well known to those skilled in the art that current armor cannot stop every kind of bullet that hits it, hence there are bullets known as "armor piercing bullets." Typically, such bullets have a carbide head that efficiently deflects energy-absorbing armor components. Currently known armor cannot safely stop these types of bullets. On an ever-changing battlefield, the enemy is constantly upgrading the weapons it uses to defeat available protection. A back-and-forth struggle exists between updating the armor worn for protection and the weapons used to penetrate that protection.

In view of these problems, the United States Military is constantly assessing ways to improve soldier and vehicle protection. Armor requirements issued by the Military are updated often as the United States Military requires that armor worn by troops be better suited to stop faster and heavier bullets. Armor considered acceptable for use with military and law enforcement personnel, in light of recent changes in minimum acceptable standards, will soon be considered insufficient. In November 2004, changes were made to the desired standards of armored plating used by the Military. These changes were brought about, at least in part, by newly developed ammunition and explosives used by enemies of the United States of America. For example, the most desirable armor is that which can safely stop both individual bullets and shrapnel fragments. Armor should be able to protect against multiple impacts from 0.30 caliber and 0.50 caliber Fragment Simulating Projectiles ("FSP's") and 7.62 mm cartridge.

Currently known armor worn by military and law enforcement personnel cannot stop an "armor piercing" bullet. Moreover, such known products have proven unsatisfactory in safely stopping the very type of object produced by explosive devices currently used by insurgents in Iraq.

It is important to note that the strength of known armored plating relies on a general fiberglass composite for adequate protection. In a sense, such a composite acts like a sponge. As the bullet traverses the fiberglass composite, it is wedged within the composite until friction sufficiently robs the bullet of mechanical energy. However, those wishing to penetrate such armor may exploit this safely mechanism. For example, it is well known to those skilled in the art that attempts have been made, with varying degrees of success, to coat bullets with TEFLON. The coating on these bullets is particularly effective in sufficiently reducing friction between the bullet and fiberglass composite so that each bullet passes through with minimal energy loss. As such, the very mechanism relied upon to provide safety might be exploited very easily.

SUMMARY OF THE INVENTION

The general purpose of the present invention, which will be described subsequently in greater detail, is to provide an improved armored plate system which has many of the advantages of such systems known in the art and many novel features that result in armored plate system which is not anticipated, rendered obvious, suggested, or even implied by any of the known systems, either along or in any combination thereof.

In satisfaction of the above, the present invention provides an improved armored plate system that offers high performance, low weight, and low cost. The present invention, by way of a novel use of components, and a novel combination of those components, provides for armor that can safely stop incoming bullets that known systems cannot. Also, the present invention avoids the hazards associated with known armor in so much as it is not friable. Nevertheless, the present system remains as flexible and as lightweight as known armored plate systems.

The present system is characterized by a series of tubes arranged with one another to form a protective array. Each tube slides past adjacent tubes to fit into place. These tubes have slanted sidewalls so that one overlaps the next to provide continuous protection even when the array is placed on a curved surface. Within each tube, a series of laminated and embossed components are layered upon one another. These laminated pieces act in concert to absorb and dissipate kinetic energy of a bullet striking the apparatus. Energy associated with an incident bullet is distributed along and between each laminated piece. The embossed pieces serve to hold laminated members in alignment and allow each tube to bend while preserving the integrity of each laminated member.

Particular forms of the system are thought to have laminated components of one or more particular finishes. For instance, useful forms are envisioned where laminated components have a powder coat finish or carbide finish. Other forms of the present invention are thought to be particularly useful where the component pieces of the armor system are strengthened with basalt. Such a form is thought to be particularly advantageous as basalt provides for extraordinary high strength yet is lightweight.

In view of the above, the present system solves problems associated with known protective armor. The present apparatus does not rely on friable material that often irritates the skin, eyes and lungs. Reducing the friction associated with an incoming bullet, such as with a TEFLON coating, will not thwart the effectiveness of the present invention. The combination of system components lends itself to flexibility in fitting around curved surfaces while offering seamless protection. Finally, the present system may have protective finishes that further strengthen the system.

In its most preferred form, the present system is capable of stopping:

7.62 mm×39 (PS—steel core penetrator), 7.62 mm×54R LPS Ball (sniper and crew served), 7.62 mm×54R API, 0.30 calibers Fragment Simulating Projective ("FSP"), 0.50 caliber FSP, thereby fully satisfying, and surpassing, current military requirements. Other known systems, alone or in combination, are simply not capable of providing this degree of protection in such a lightweight and flexible format.

BRIEF DESCRIPTION OF THE DRAWINGS

Applicant's invention may be further understood from a description of the accompanying drawings, wherein unless otherwise specified, like referenced numerals are intended to depict like components in the various views.

DETAILED DESCRIPTION OF THE PREFERRED EMBODIMENT

Figure 1:
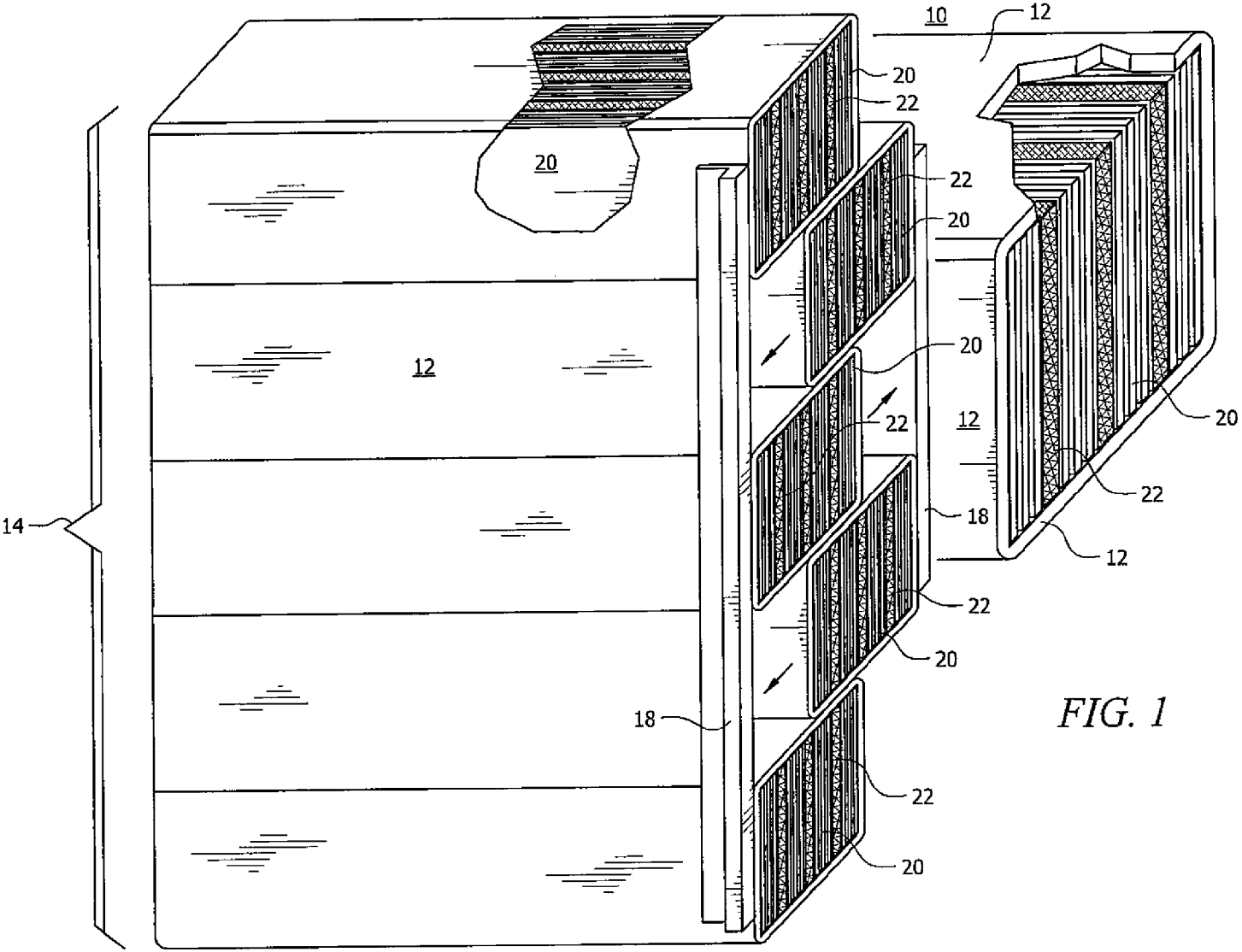
FIG. 1 is a perspective view of the preferred embodiment of the present invention.

Referring to FIG. 1, the apparatus of the present invention is generally designated by the reference numeral 10. The most useful embodiments of apparatus 10 are envisioned as being used to fit both military and law enforcement personnel and the vehicles that transport those personnel. As will be discussed in greater detail, apparatus 10 lends itself to efficient storage and transport, making it ideal for being shipped to troops all over the world.

Figure 2:
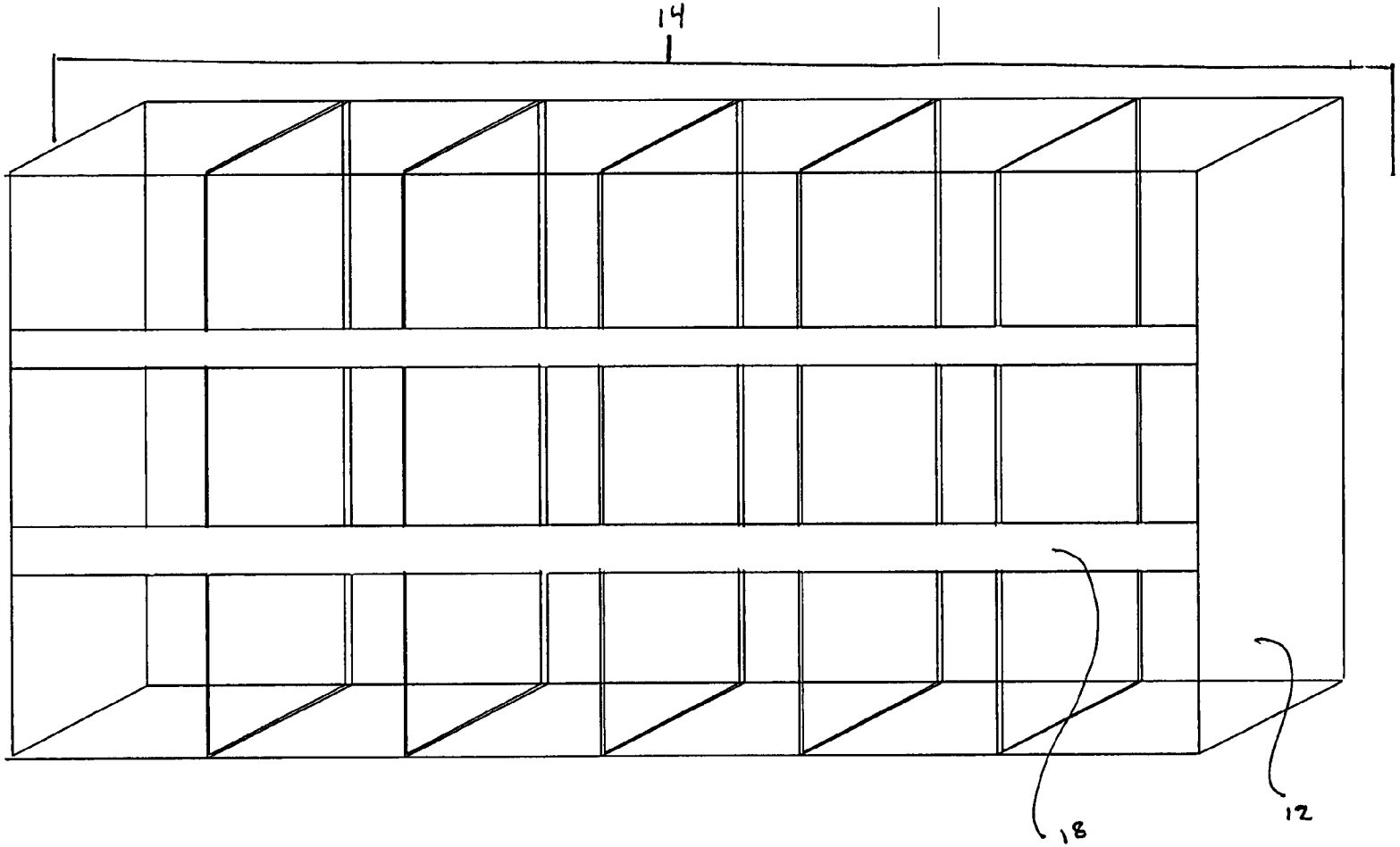
FIG. 2 is another perspective view of the preferred embodiment of the present invention.

Apparatus 10 is characterized by a series of housing tubes 12. In the preferred embodiment, housing tubes 12 are elongate tube members having a rectilinear cross section. Each housing tube 12 is arranged with one another in parallel fashion along its length. The assembly of each housing tube 12 forms a protective array 14. As best seen in FIG. 1 and FIG. 2, each housing tube 12 has slanted sidewalls so that, when arranged, an intermediate tube sufficiently overlaps the next tube and is sufficiently overlapped by the previous tube. Such an arrangement is thought to be particularly useful in maintaining continuity in protection when the apparatus is placed on a curved surface, such as a person's torso or vehicle side panel. During use, each housing tube 12 will have a surface resting against a person or vehicle on which the apparatus is placed, a surface facing that person's or vehicle's environment, and a pair of sidewalls juxtaposed with the sidewalls of adjoining housing tubes.

Figure 3:
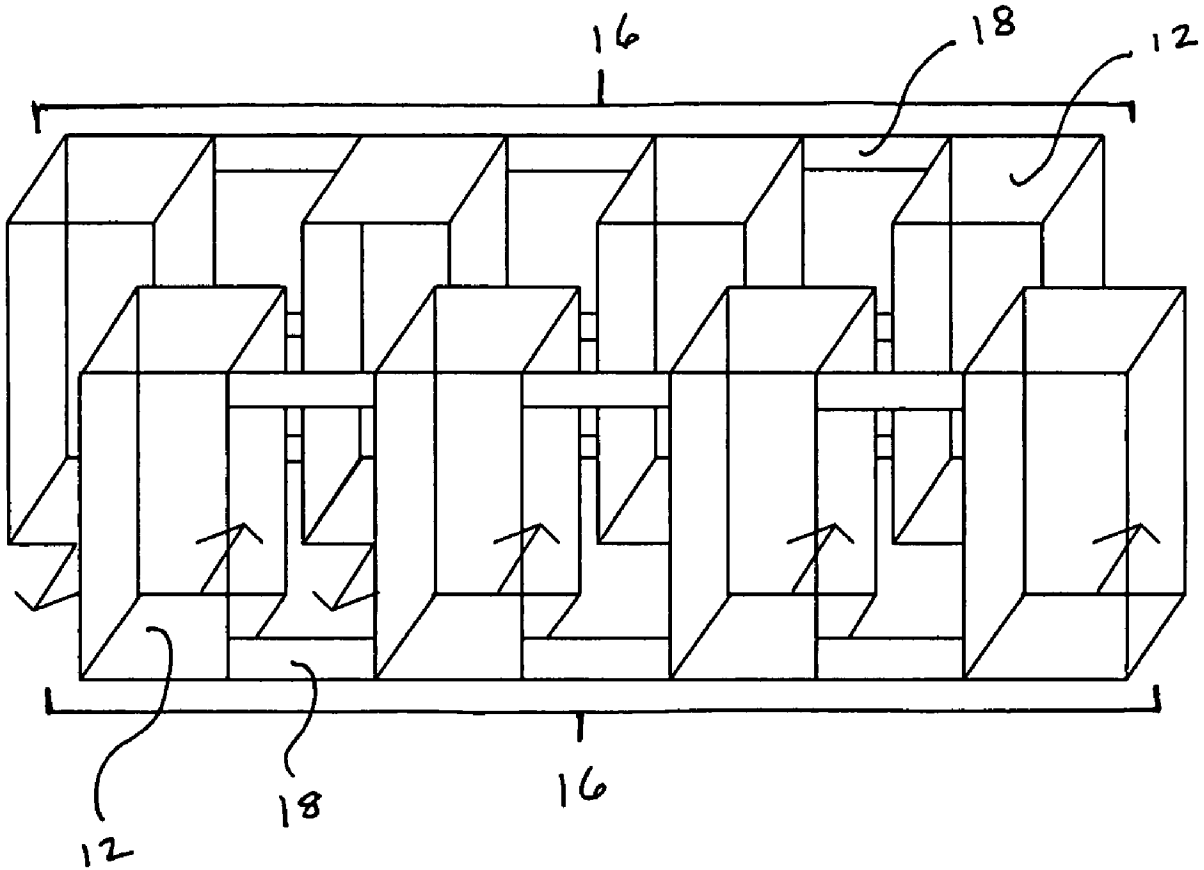
FIG. 3 is an exploded perspective view of the preferred embodiment of the present invention.

As best seen in FIG. 2 and FIG. 3, a protective array 14 of housing tubes 12 is formed as opposing housing tube strings 16 engage one another from opposite directions. Each housing tube string 16 is comprised of a series of spaced housing tubes 12 held in position by a series of straps 18 that extend substantially perpendicular to the length of each housing tube 12. Each housing tube 12 is spaced from the other along string 16 so as to allow a housing tube 12, from an opposing tubbing string 16, to fit within that space. Tubing array 14 is formed as tubes 12 contained in opposing strings 16 slide along one another until a continuous, single array 14 is formed. The particular arrangement involving tubing strings 16 is particularly advantageous in so much as it allows for a straightforward assembly process that can be accomplished in a very short period of time. Moreover, tubing arrays 14 and tubing strings 16 can be stacked upon one another during storage or transport in a compact manner. As such, distribution of apparatus 10, to areas where it is most needed but difficult to reach, can be accomplished in an efficient manner. Further, such an arrangement offers flexibility as each tube 12 may move in relation to the other so that array 14 may align with, and provide continuous protection for, objects having curved surfaces.

Figure 4:
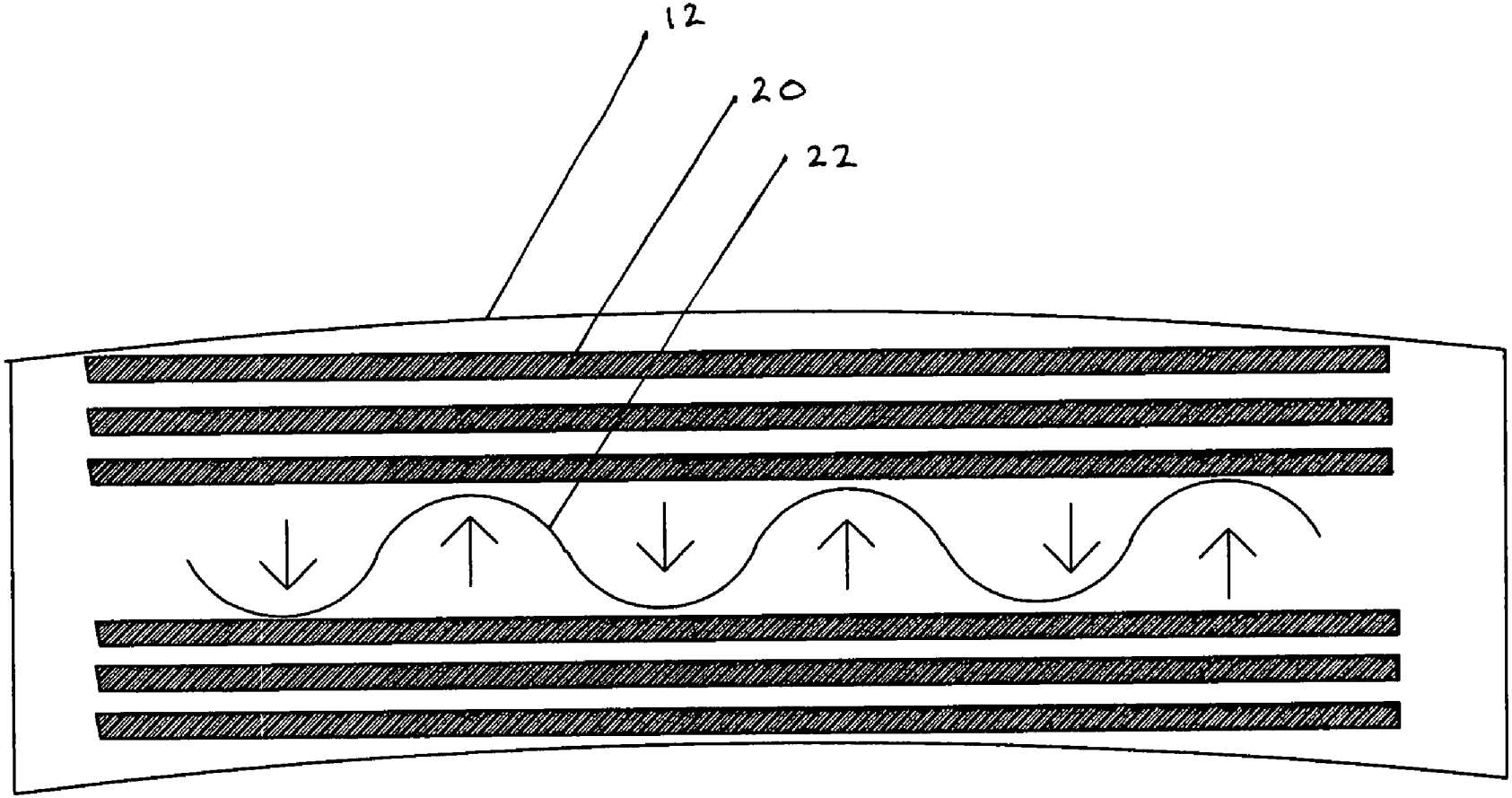
FIG. 4 is a cross sectional view of the preferred embodiment of the present invention.

Referring to FIG. 1 and FIG. 4, contained within each housing member 12 is a series of laminated members 20 and one or more embossed members 22. Preferably, within each tube 12, laminated members 20 are layered upon one another, with the embossed member 22 contained in or near the middle of the layers. In the preferred embodiment, laminated members 20 and embossed member 22 are ANSI A225.1 or ASTM D3953-91 certified milled steel. Such material is preferred as it is held out for its good metallurgy properties. This type of steel particularly is strong, is somewhat malleable, and is able to bend or give without presenting the threat of producing shards or exploding. Other useful embodiments are envisioned where these members may be comprised of other materials. For example, particularly useful embodiments are envisioned where one or more of the laminated members is Carbide plate. Carbide, or Carbide plating, is more expensive; however, its superior performance with regard to stopping "armor piercing" bullets may well be worth the extra cost. Other useful embodiments are envisioned where laminated members 20 are powder coated. Powder coating is thought to be particularly beneficial in so much s the coating acts as an agent not only for holding laminated members 20 together, but as a means of bonding ceramics or other anti ballistic materials to any of the various surfaces of apparatus 10. A powder coating finish further offers blast protection, anti fragmentation properties, and contains has no friable materials. Powder coating can be fire proofed and can be exposed to salt and UV radiation without substantial degradation. Finally, useful embodiments are envisioned where members 20 and 22 (and perhaps other components) are coated with or contain a basalt fiber material. For instance, basalt fibers may be contained within an epoxy coating on these components or may be mixed within the milled steel to act as a reinforcement mechanism. The use of basalt is particularly advantageous as it has particularly high tensile strength and is corrosion resistant. Sudaglass Fiber Technology, Inc., of Houston, Tex. USA, manufacturers such a material.

Both the laminated members 20 and the embossed member 22 lend several novel attributes to apparatus 10. Providing for several laminated members 20 requires that an incoming bullet traverse several strike faces. As such, each layer acts in concert with other layers to absorb the kinetic energy of the bullet. Having several laminated layers, as opposed to a single stock piece, lend more flexibility to the apparatus. A single piece of stock is more likely to chip or shatter when struck by a bullet, or simply deflect the bullet. However, the arrangement of the present apparatus allows each layer to bend, or give, to some degree upon bullet impact. Such a bending or giving characteristic provides for an inelastic collision between a bullet and laminated members 20. As such, the kinetic energy of an incoming bullet is converted to heat energy, which is better dissipated along and between the faces of adjacent laminated members. It is well known to those skilled in the art that a single piece of metal cannot readily dissipate heat energy in the same manner. As the bullet undergoes repeated inelastic collisions with individual layers, its kinetic energy dissipates faster than with other known systems.

The use of embossed member 22, of sinusoidal nature along its length, further lends novel attributes to the present apparatus. Specifically, embossed member 22 provides sufficient tension between laminated members 20 and housing tube 12 so that laminated members 20 remains aligned therein. Embossed member 22 further serves to press each laminated member 20 against the interior of housing tube 12 and allows tube 12 to bend along its length while laminated members 20 remain straight. More specifically, upon bending, embossed member 22 takes on a lower amplitude so that the combination of laminated members 20 and embossed members 22 take on a lower profile. This flexibility accommodates bends in housing tube 12 while allowing laminated members 20 to remain straight. While the preferred embodiment is described as having a single embossed layer 22 as intermediate layer between laminated members 20, particularly useful embodiments are envisioned as having three embossed members 22. In such an embodiment, additional embossed members would be placed between an outer laminated member and an interior surface of housing tube 12. Such an embodiment would provide for an even greater degree in bending flexibility, while preserving structural integrity of laminated members 20.

The use of metal components, rather than some fiberglass composite, is presents other advantages as well. More specifically, the components of the present invention are not friable; as such, adverse effects on the body such as itching, irritation, and inhalation of particles and dust are eliminated. Further, apparatus 10 does not depend on friction to extent fiberglass containing armor does. As such, TEFLON coating, or some equivalent will not mitigate the effectiveness of apparatus 10.

Apparatus 10 may be fit onto the torso of an individual or the side panel of a vehicle by any one of several attachment means. For instance, a series of "tie on" straps may be looped through the ends of each tube 12 and tied together. Or, metal straps or hooks may be tack welded along the edges and configured to engage one another or components of a vehicle. Certainly, several means to easily attach apparatus 10 to the object of protection will certainly be apparent to those skilled in the art.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A protective armored plate array, comprising:

a series of housing tubes arranged with one another in parallel fashion along their lengths forming an array of housing tubes where each housing tube has slanted sidewalls so that a housing tube partially overlaps a first adjacent housing tube and is partially overlapped by a second adjacent housing tube;

a series of laminated members where two or more laminated members are layered within each housing tube;

a series of sinusoidal members, where one or more of said sinusoidal members are layered in combination with said laminated members within each housing tube; and an attachment means in combination with said array configured for attaching said array to an object to be protected and wherein said armored plate array is a ballistic penetration prevention array.

2. The armored plate array of claim 1 wherein said laminated members and said sinusoidal members have a powder coated outer surface.

3. The armored plate array of claim 1 wherein said laminated members and said sinusoidal members are coated with a material comprising basalt.

4. The armored plate array of claim 1 wherein a first housing tube string is formed by a first sct of housing tubes held spaced from one another by a first series of straps traversing said first housing tubes and a second housing tube string is formed by a second set of housing tubes held spaced from one another by a second series of straps traversing said second housing tubes, where said first housing string and said second housing tube string engage one another to form said array as said first housing tubes slide between said second housing tubes and said second housing tube slide between said first housing tubes.

* * * * *